United States Patent [19]

Misumi

[11] 4,081,713

[45] Mar. 28, 1978

[54] DIRECTLY HEATED OXIDE CATHODE

[75] Inventor: Akira Misumi, Mobara, Japan

[73] Assignee: Hitachi, Ltd., Japan

[21] Appl. No.: 710,303

[22] Filed: Jul. 30, 1976

[30] Foreign Application Priority Data

Jan. 28, 1976 Japan ..... 51-7491
Jan. 28, 1976 Japan ..... 51-7496

[51] Int. Cl.[2] ..... H01J 1/14; H01J 19/06; H01K 1/04

[52] U.S. Cl. ..... 313/346 R; 252/521

[58] Field of Search ..... 313/345, 346; 252/521

[56] References Cited

U.S. PATENT DOCUMENTS

| | | | |
|---|---|---|---|
| 3,183,396 | 5/1965 | Becker et al. | 313/346 X |
| 3,240,569 | 3/1966 | Buescher | 313/346 |
| 3,286,119 | 11/1966 | Sugawara et al. | 313/346 |
| 3,351,486 | 11/1967 | Buescher et al. | 313/346 |
| 3,374,385 | 3/1968 | Lattimer | 313/345 |
| 3,558,966 | 1/1971 | Hill | 313/345 |
| 3,745,403 | 7/1973 | Misumi | 313/345 |

*Primary Examiner*—Saxfield Chatmon, Jr.
*Attorney, Agent, or Firm*—Craig & Antonelli

[57] ABSTRACT

A directly heated oxide cathode comprises a base metal of alloy containing Ni as a host material, an electron emissionable oxide of alkaline earth metal deposited on the base metal, and powders of metal selected from Ni sample substance, Co simple substance, Ni-Co alloy, alloy containing Ni, Ni-Co, or Co as a host material, and alloy containing Ni as a host material and a reducing agent such as Zr, deposited on both sides of the base metal onto which the oxide is deposited. Provision of the powders of metal on both sides can minimize deformation of the base metal and prevent peeling of the oxide from the cathode effectively. Provision of a reducing agent in the powders of metal further assures a sufficient supply of the reducing agent to the oxide, thereby effectively maintaining the electron emissionability and life of the oxide for a longer period of time.

15 Claims, 4 Drawing Figures

DIRECTLY HEATED OXIDE CATHODE

This invention relates to a directly heated oxide cathode, and more particularly to a directly heated oxide cathode structure of base metal deposited with an oxide of alkaline earth metal.

A cathode is generally used in a receiving tube, discharge tube, cathode-ray tube, etc., but usually the cathode used in the cathode ray tube must quickly act to display images instantaneously. That is, the starting time must be quick.

On the other hand, the cathode is classified into two types, that is, indirectly heated oxide cathode and directly heated oxide cathode. In the indirectly heated oxide cathode the starting time is almost 20 seconds, whereas in the directly heated oxide cathode, the starting time is as very short as 1 to 2 seconds. Thus the directly heated oxide cathode is most suitable as a quick start type.

The present invention will be described, referring to the accompanying drawings.

Figure 1:
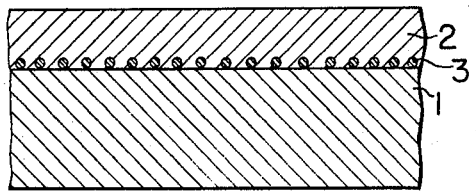
FIG. 1 is a cross-sectional, enlarged view of one example of the conventional directly heated oxide cathode structure.

In FIG. 1, numeral 1 is a base metal capable of generating heat when a current is passed therethrough, and is formed from a Ni alloy containing a high melting point metal capable of increasing mechanical strength, such as W, and a reducing agent such as Mg, Al, Si, and Zr. Numeral 2 is an oxide of alkaline earth metal having an electron emissionability, and is applied onto the base metal 1. The upper surface of the base metal 1 is roughened by grains 3 of particle sizes of a few μm containing Ni as a host material by depositing a few milligrams of the grains onto the base metal 1 per 1 $cm^2$ of the base metal by blow, and sintering the grains in vacuum or in a hydrogen gas atmosphere, whereby the base metal 1 is firmly coated with the oxide 2.

Figure 2:
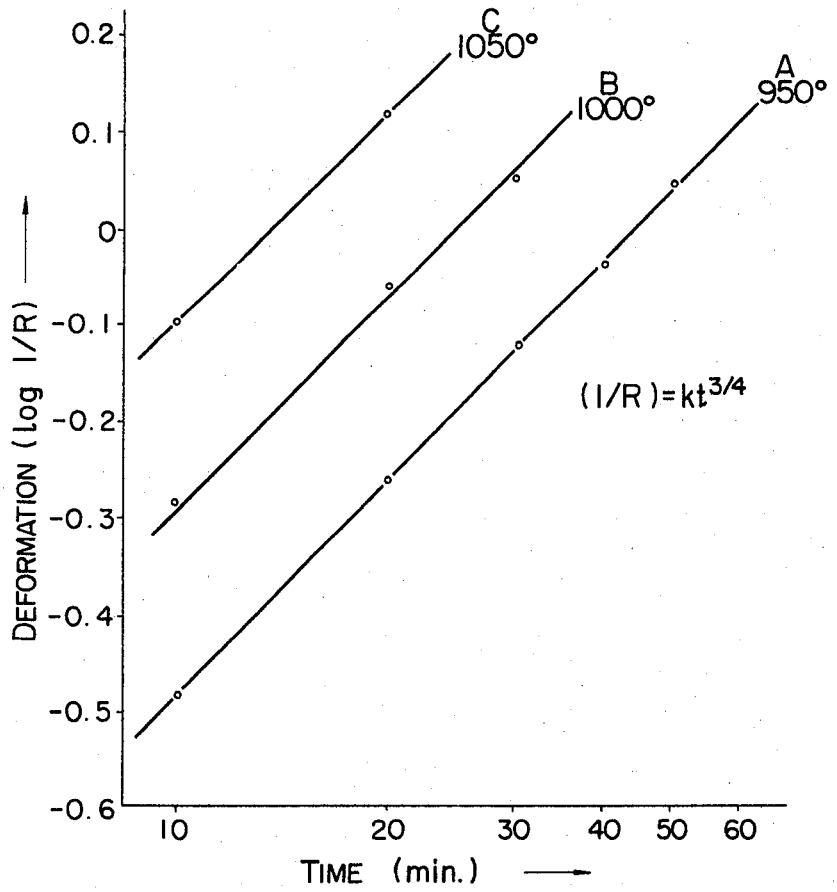
FIG. 2 is a characteristic diagram showing changes in the deformation of base metal with time.
Figure 3:
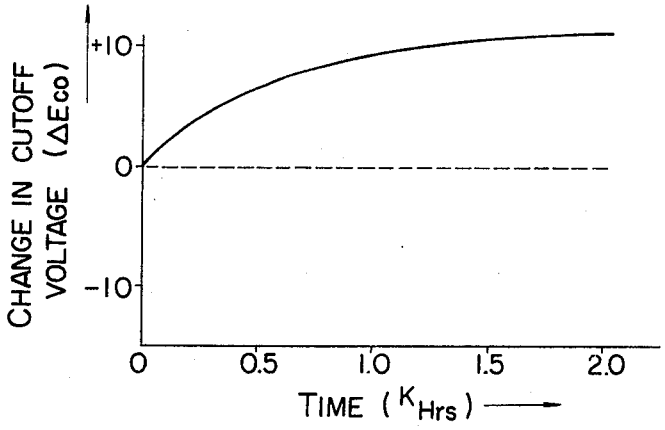
FIG. 3 is a characteristic diagram showing changes in the cutoff voltage with time.

However, in such a directly heated oxide cathode structure, a diffusion rate of the Ni powders 3 into the base metal 1 is increased with the heat generation of the base metal 1, and consequently a strain develops on the surface layer of the base metal 1 at the side in contact with the Ni powders 3, thereby deforming the base metal 1 towards a grid electrode side into a convex, spherical shape. The curvature of deformation, that is, reciprocal number of radius R (cm), is increased with increasing service time of the cathode structure, as shown in FIG. 2, where the time (min.) is plotted on the abscissa, and the reciprocal number of radius R is plotted on the ordinate as deformation. Curve A is plotted for the base metal temperature of 950° C, curve B for 1000° C, and curve C for 1050° C. As a result, a distance between the oxide 2 and a grid electrode is gradually changed, and consequently the cutoff voltage is changed. In FIG. 3, a change $\Delta E_{CO}$ in the cutoff voltage $E_{CO}$ is plotted against time. Thus, in the case of a color cathode-ray tube based on such cathode structure, the setting condition for operating point of three electron gun is changed during the service period, and a white balance is disadvantageously lost. If the deformation of the base metal 1 is further increased, the oxide 2 will be disadvantageously peeled off.

One object of the present invention is to prevent the deformation of the base metal 1 constituting the directly heated oxide cathode structure, thereby eliminating disadvantages of change in the operating point of electron gun and peeling of the oxide 2.

To eliminate these disadvantages, metallic powders are deposited also onto the back side of base metal 1 to proceed with the diffusion of Ni or Co at both sides of the base metal 1 in the present invention.

Figure 4:
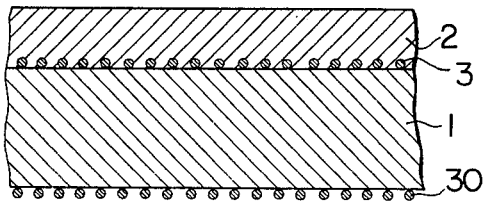
FIG. 4 is a cross-sectional, enlarged view of one embodiment of the present directly heated oxide cathode structure.

In FIG. 4, one embodiment of a cathode structure of direct heating type according to the present invention is shown, where the same reference numerals are used for the same members as in FIG. 1. In FIG. 4, numeral 30 is powders comprising Ni as a host material, and is deposited onto the surface of base metal at the side opposite to the side to which the powders 3 are deposited. The powders 30 are sintered at the same time when the powders 3 are sintered. In detail, carbonyl nickel powders usually having particle size of a few μm are deposited as the powders 3 in a deposition ratio of 1.5 $mg/cm^2$, and therefore the same carbonyl nickel powders having particle sizes of a few μm must be deposited to the back side of the base metal 1 as the powders 30 in the same deposition ratio of 1.5 $mg/cm^2$. In such a cathode structure, Ni diffusion proceeds at both sides of the base metal 1 by the heat generation of the base metal 1, and the strains developed and added to the base metal 1 can be balanced at both face and back sides of the base metal 1, thereby minimizing the deformation. That is, loss of the white balance and peeling of the oxide can be prevented thereby.

As the metal powders 3 and 30 to be deposited onto both face and back sides of the base metal 1, powders of nickel simple substance as mentioned above, powders of Co simple substance, powders of Ni-Co alloy, or powders of alloys containing Ni, Ni-Co, or Co as a host material and a small amount of elements giving no adverse effect upon the cathode itself, such as a reducing agent, can be used. In the case of the powders of Ni-Co alloy, a mixing ratio of Ni to Co can be selected as desired.

It is rather preferable to deposit the metal powders of the same kind onto both face and back sides of the base metal than to deposit the metal powders of different kinds on it, but it is practically not objectionable to deposit a combination of different kinds of metal powders on it, for example, by depositing powders of Ni simple substance onto the face side and powders of Co simple substance onto the back side.

As to the deposition ratio of the powders, 1.5 $mg/cm^2$ is described before, but when the deposition ratio is less than 0.3 $mg/cm^2$, there is a risk of oxide peeling, and when the deposition ratio exceeds 4.0 $mg/cm^2$, a large deformation of the cathode and a large fluctuation in the cathode temperature appear. Thus, the practical range of the deposition ratio of the powders is 0.3 to 4.0 $mg/cm^2$.

Even in the foregoing cathode structure, there is such a disadvantage that a reducing agent to be supplied from the base metal 1 to the oxide 2 prepared by heating and decomposing a carbonate in vacuum is quickly decreased, because the base metal 1 of the directly heated oxide cathode structure is thinner than that of indirectly heated oxide cathode, and a sufficient amount of the reducing agent cannot be stored in the base metal 1. That is, the reducing agent cannot be supplied sufficiently, and the life of the cathode will be shortened.

Therefore, another object of the present invention is not only to prevent the deformation of the base metal 1 and peeling of oxide, but also to sufficiently supply the reducing agent to the oxide, thereby improving an electron emissionability of the oxide.

That is, according to another embodiment of the present invention, a reducing agent, for example, Zr is contained in the metal powders 3 and 30 in FIG. 4.

In the cathode structure as above, reduction of the oxide takes place according to the following reaction formula:

$$3BaO + Zr \rightarrow BaZrO_3 + 2Ba \uparrow$$

The reducing agent Zr is supplied not only from the base metal 1, but also from the metal powders 3, and also from the metal powders 30 at the back side of the base metal 1 continuously for a long period of time, and thus the oxide can maintain its electron emissionability and its life for a longer period of time. In that case, the amount of Zr to be added to the powders 3 and 30 is not restricted to a solid solution range of Zr in the alloy powders. The solid solubility of Zr in an Ni-based alloy is generally about 0.2 to about 0.3% by weight, but Zr in excess of the solid solubility exists as an intermetallic compound in the powders. When Zr within the solid solubility range is consumed according to said reaction formula, the intermetallic compound is then decomposed to keep Zr in the solid solution phase at about 0.2 to about 0.3% by weight, and thus the intermetallic compound acts as a storage house. Therefore, the powders containing Zr above its solid solution range continue to supply Zr at the same rate as that of the powders containing 0.2 to 0.3% by weight of Zr until the intermetallic compound disappears. Thus, such powders can keep the reaction of said reaction formula going for a very long period of time and can maintain the electron emissionability of the oxide for a longer period of time.

As to the amount of the reducing agent Zr in the powders, the amount of less than 0.04% by weight of Zr is not substantially effective for the prolongation of the cathode life, and its upper limit is determined by a limit incapable of forming a lower melting point intermetallic compound. Thus, the practically preferable range of Zr is 0.1 to 10% by weight.

In the foregoing embodiment, description is restricted to the use of powders of Ni-Zr alloy, but even if a mixture of powders of alloy free from Zr and powders containing Zr is used to adjust the Zr content, practically same effect can be obtained as when powders of Zr alloy at a lower Zr concentration is used.

Other reducing agents than Zr, for example, C, Mg, Si, Al, etc. have a similar effect in principle to that of Zr, but side action as not encountered in the case of Zr sometimes appears, and thus a sufficient care should be paid to their use. That is, for example, in the case of C, it is difficult to obtain powders in which C in the amount over the solid solubility (approximately 0.1% by weight) is uniformly distributed, and a special precaution must be paid to stable assurance of the quality. In the case of Mg, an increase in Mg content gives rise to vigorous evaporation of Mg, and more liable formation of a low melting point compound. Thus, a Mg alloy at a Mg concentration as low as possible should be used. Practical range for Mg content is about 0.1 to about 1.0% by weight. In the case of Si and Al, their solid solution limits are as high as about 7% by weight, and when the powders having a higher Al or Si content are used, the supply rate of Al or Si is excessively high, increasing the resistance of intermediate layer, and consequently giving an adverse effect upon the function of oxide cathode. Thus, in using these reducing agents, it is necessary to take into account the characteristics of cathode to be actually applied to.

As described above, the present invention provides a directly heated oxide cathode structure comprising a base metal of alloy containing Ni as a host material capable of generating heat when an electric current is passed therethrough, and an oxide of alkaline earth metal having an electron emissionability deposited on the base metal, and powders of metal selected from Ni simple substance, Co simple substance, Ni-Co alloy, alloy containing Ni, Ni-Co or Co as a host material, and alloy containing Ni as a host material and a reducing agent, deposited on both sides of the base metal onto which said oxide is deposited. According to the cathode structure of the present invention, deformation of the base metal itself can be minimized. For example, in a color cathode-ray tube, loss of white balance can be prevented. Furthermore, peeling of the oxide from the cathode can be effectively prevented not only in the color cathode-ray tube, but also in other appliances using cathodes. Furthermore, the use of powders of metal containing Ni as the host material and a reducing agent as the metal powders assures not only the prevention of deformation of the base metal and peeling of the oxide, but also a sufficient supply of the reducing agent to the oxide, thereby effectively maintaining the electron emissionability and life of the oxide for a longer period of time.

What is claimed is:

1. In a directly heated oxide cathode comprising a base metal substrate of alloy containing Ni as a host material and a layer of an electron emissionable oxide of alkaline earth metal deposited on a face side of the base metal substrate, an improvement which comprises powders of metal selected from the group consisting of Ni simple substance, Co simple substance, Ni-Co alloy, and alloy containing Ni, Ni-Co, or Co as a host material, deposited on both the face and back sides of the base metal substrate onto which the oxide is deposited whereby strains developed during diffusion of Ni are balanced on the face and back sides of the base material substrate thereby minimizing deformation thereof.

2. A directly heated oxide cathode according to claim 1, wherein the base metal contains at least W and a reducing agent.

3. A directly heated oxide cathode according to claim 2, wherein the reducing agent is Mg, Al, Si, or Zr.

4. A directly heated oxide cathode according to claim 1, wherein the powder of metal is deposited in a deposition ratio of 0.3 to 4.0 mg/cm$^2$.

5. A directly heated oxide cathode according to claim 1, wherein the powders of metal selected from the alloy containing Ni as a host material contains a reducing agent.

6. A directly heated oxide cathode according to claim 5, wherein the reducing agent is Zr, C, Mg, Si, or Al.

7. A directly heated oxide cathode according to claim 5, wherein the reducing agent is Zr.

8. A directly heated oxide cathode according to claim 7, wherein 0.1 to 10% by weight of Zr is contained.

9. In a directly heated oxide cathode comprising a base metal substrate of alloy containing Ni as a host material and a layer of an electron emissionable oxide of alkaline earth metal deposited on one side of the base metal substrate, an improvement which comprises powders of metal containing Ni as a host material and a reducing agent, and powders of Ni-based alloy free from a reducing agent, deposited on both sides of the base metal substrate onto which the oxide is deposited whereby strains developed during diffusion of Ni are balanced on both sides of the base material substrate thereby preventing distortion thereof and improving electron emissionability of the oxide.

10. A directly heated oxide cathode according to claim 9, wherein the powders are deposited in a deposition ratio of 0.3 to 4.0 mg/cm$^2$.

11. A directly heated oxide cathode according to claim 10, wherein the reducing agent is Zr.

12. A directly heated oxide cathode according to claim 4, wherein the powders of metal deposited on each side of the base metal substrate are of the same kind.

13. A directly heated oxide cathode according to claim 12, wherein the powders of metal are deposited at the same ratio of deposition on each side of the base metal substrate.

14. A directly heated oxide cathode according to claim 11, wherein the powders of metal deposited on each side of the base metal substrate are of the same kind.

15. A directly heated oxide cathode according to claim 14, wherein the powders of metal are deposited at the same ratio of deposition on each side of the base metal substrate.

* * * * *